US005520841A

United States Patent [19]

Block et al.

[11] Patent Number: 5,520,841

[45] Date of Patent: May 28, 1996

[54] PUMPABLE ALKALINE CLEANING CONCENTRATES

[75] Inventors: Christian Block, Cologne; Petra Uhl, Krefeld; Yves Guinomet, Korschenbroich; Armin Friesendorf; Juergen Falkowski, both of Duesseldorf, all of Germany

[73] Assignee: Henkel Kommanditgesellschaft auf Aktien, Duesseldorf, Germany

[21] Appl. No.: 338,486

[22] Filed: Jan. 18, 1995

[30] Foreign Application Priority Data

May 18, 1992 [DE] Germany ..... 42 16 405.2

[51] Int. Cl.[6] ..... C11D 7/06

[52] U.S. Cl. ..... 252/174.23; 252/174.24; 252/135; 252/539; 252/174.19; 252/174

[58] Field of Search ..... 252/174.24, 174.23, 252/135, 539, 174.19, 174, 156

[56] References Cited

U.S. PATENT DOCUMENTS

| | | | |
|---|---|---|---|
| 3,691,107 | 9/1972 | Erdy et al. | 252/544 |
| 3,829,387 | 8/1974 | Wise et al. | 252/156 |
| 3,981,826 | 9/1976 | Munro | 252/526 |
| 4,157,921 | 6/1979 | Baturay et al. | 134/4 |
| 4,396,525 | 8/1983 | Rubin et al. | 252/174.25 |
| 4,521,332 | 6/1985 | Milora | 252/527 |
| 4,601,845 | 7/1986 | Namnath | 252/99 |
| 4,704,404 | 11/1987 | Sanderson | 514/568 |
| 4,731,194 | 3/1988 | Rossmann et al. | 252/160 |
| 4,784,788 | 11/1988 | Lancz | 252/114 |
| 4,797,231 | 1/1989 | Schumann et al. | 252/547 |

FOREIGN PATENT DOCUMENTS

| | | |
|---|---|---|
| 0111285 | 6/1984 | European Pat. Off. . |
| 0199195 | 10/1986 | European Pat. Off. . |
| 0301882 | 2/1989 | European Pat. Off. . |
| 0965215 | 7/1964 | United Kingdom . |

OTHER PUBLICATIONS

"Rationelle Vorbehandlung durch kontinuierlichen Betrieb von Entfettungsbaedern", Metalloberflaeche, vol. 39 (1985), Seiten 41 to 44.

Chemical Abstracts vol. 100 (1984), Seite 114, 100:70377k.

*Primary Examiner*—Paul Lieberman
*Assistant Examiner*—Wyatt B. Pratt
*Attorney, Agent, or Firm*—Ernest G. Szoke; Wayne C. Jaeschke; Real J. Grandmaison

[57] ABSTRACT

A composition and process for producing a storable, pumpable alkaline cleaning concentrate comprising an aqueous alkali metal hydroxide having dispersed therein alkaline builder and surfactants, and a stabilizer therefor comprising the combination of:

(a) polyacrylic acid or alkali metal polyacrylate; and (b) glycerol or polyglycerol.

29 Claims, No Drawings

PUMPABLE ALKALINE CLEANING CONCENTRATES

BACKGROUND OF THE INVENTION

This invention relates to storable, pumpable alkaline cleaning concentrates, more particularly for the industrial cleaning of metal surfaces, based on concentrated aqueous dispersions of alkaline builders, nonionic and/or anionic surfactants and stabilizers in alkali metal hydroxide solutions.

FIELD OF THE INVENTION

The most important components of these concentrates from the cleaning point of view are builder and surfactant systems. For practical application, the properties of these basic mixtures of builders and nonionic and/or anionic surfactants are often adapted to the particular application envisaged by the addition of other ingredients, such as complexing agents and corrosion inhibitors.

The aqueous solutions of the alkaline cleaning compositions have a pH value in the range from about 11 to 14. They are particularly suitable for difficult cleaning tasks, for example for the removal of thick oil and pigment soils in repair shops and for the cleaning of containers and equipment. In addition, products of this type are used in particular for the fine cleaning of metal surfaces where metallically clean surfaces are required. This applies, for example, to cleaning before and after hardening processes, in the cleaning of strip steel before annealing and before coating and in the pretreatment of workpieces for electroplating, phosphating, painting and enameling. Extremely clean workpiece surfaces are obtained with cleaning solutions of the type in question coupled with high soil suspending power of the bath.

Typical alkaline cleaners are generally produced in the form of powders by mixing 80 to 100% by weight of alkaline builders and 0 to 20% by weight of various anionic and/or nonionic surfactants. The most common inorganic builders are alkaline silicates, phosphates and carbonates of sodium and/or potassium. Gluconates, alkanolamines, polycarboxylic acids, polyhydroxycarboxylic acids and phosphonates are used where necessary as complexing agents. The surfactant mixtures consist of low and high ethoxylates and propoxylates of alkylphenols and/or fatty alcohols with various chain lengths and/or fatty amines with various chain lengths and/or fatty acids or sulfonic acids. These ingredients are present in the alkaline cleaners in various combinations and relative concentrations. In general, the composition of an optimal product can only be empirically determined by special sampling.

Powder-form cleaning compositions have a pronounced tendency to emit dust and, accordingly, can affect or even endanger the user when it comes to dosing.

Difficulties such as these can largely be avoided with liquid or at least pumpable cleaning products which, in general, are very much easier to dose. However, the formulation of such cleaning compositions involves two problems, namely: in the majority of cases, sodium compounds of the builders can only be handled as thermodynamically stable solutions at ambient temperature (room temperature) up to a maximum concentration of around 100 to 150 g/l. By contrast, the corresponding potassium compounds can be dissolved in quantities of around 500 g/l. Raw material costs thus rise considerably. In addition, the solubility of proven surfactants in highly alkaline high-salt solutions such as these is generally totally inadequate. Typical nonionic surfactants cannot be dissolved at all and, in the case of anionic surfactants, it is only possible to dissolve those compounds which have a very short and substantially non-hydrophobic carbon chain of 6 carbon atoms or less. Nonylphenol ethoxylates, fatty alcohol ethoxylates, fatty acids and alkylbenzenesulfonates are thus unsuitable for cleaning compositions of the type in question.

DISCUSSION OF RELATED ART

An overview of two-component cleaners containing sodium hydroxide in a separate solution is provided by C. H. Rossmann in "Rationelle Vorbehandlung durch kontinuierlichen Betrieb von Entfettungsbädern (Efficient Pretreatment by Continuous Operation of Degreasing Baths)", Metalloberfläche, Vol. 39 (1985), pages 41 to 44.

Standard industrial cleaners are normally divided into silicate and phosphate cleaners. Powder-form silicate cleaners based on sodium metasilicate and caustic soda are generally characterized by the ratio by weight of $SiO_2$ to $Na_2O$ which is established when the products are dissolved in water. Cleaners such as these can be dissolved in water at ambient temperature up to a maximum concentration of around 100 g/l providing the corresponding sodium salts and caustic soda are used. If, by contrast, the corresponding potassium salts and potassium hydroxide are used, solutions with a maximum concentration of around 500 g/l are used.

A dishwashing detergent based on an alkaline slurry containing 5 to 10% of NaOH, 15 to 40% of KOH, 10 to 35% of sodium tripolyphosphate, 5 to 15% of silicates, 0.5 to 10% of isoamylene/maleic anhydride copolymer, 0.5 to 5% of acrylic acid and 40 to 60% of water is described in Chemical Abstracts, Vol. 100 (1984), page 114, 100: 70377k, abstract of JP-A-83/108300.

U.S. Pat. No. 4,147,650 also describes an alkaline slurry intended for use as a machine dishwashing detergent. This aqueous slurry contains alkali metal hydroxides and/or silicates as alkaline builders, sodium hypochlorite as chlorine source and sodium tripolyphosphate or sodium pyrophosphate or other condensed phosphates and also sodium polyacrylate or sodium polymethacrylate as water conditioners.

U.S. Pat. No. 4,521,332 describes cleaning dispersions for cleaning rolled strip steel before subsequent processing. These storable, highly alkaline aqueous dispersions contain sodium hydroxide, sodium carbonate as fillers, alkali metal phosphates as builders and also chelating agents, nonionic surfactants and polyacrylic acid as dispersant.

In addition, DE-A-37 08 330 describes alkaline cleaning concentrates for cleaning metal surfaces before finishing or processing which contain the following components: a) 80 to 99.7% by weight of an aqueous solution of a builder or builder mixture containing 50 to 60% by weight of water and at least one alkali metal silicate and/or phosphate and b) 0.3 to 22% by weight of a surfactant combination consisting of anionic surfactants, nonionic surfactants and alkyl glucosides. However, these concentrates are solutions and not dispersions and, in addition, can only be obtained using the special surfactant combination.

Against the background of the prior art discussed in the foregoing, the problem addressed by the present invention was to provide pumpable alkaline cleaning concentrates based on aqueous dispersions of alkaline builders, alkali metal hydroxides and nonionic and/or anionic surfactants with high stability in storage. In known cleaning concentrates, the dispersion often undergoes destabilization after only a few days, as reflected in phase separation, i.e. in the sedimentation of solid constituents.

Another problem addressed by the present invention was to introduce nonionic and/or anionic surfactants in stable form into highly concentrated builder dispersions.

A further problem addressed by the present invention was to provide a pumpable cleaning concentrate for cleaning metal surfaces, more particularly steel, nonferrous metal, copper, aluminium and zinc which are to be subsequently subjected to finishing processes, such as phosphating, electroplating, enameling, painting, etc. The cleaning concentrates according to the invention would also be suitable for use for intermediate cleaning before processing, for example before annealing.

The problems stated above have been solved by storable, pumpable alkaline cleaning concentrates consisting of a concentrated aqueous dispersion of a builder or builder mixture and nonionic and/or anionic surfactants in alkali metal hydroxide solutions.

Accordingly, the present invention relates to storable, pumpable alkaline cleaning concentrates consisting of aqueous dispersions based on alkali metal hydroxides which contain alkali metal silicates and/or alkali metal phosphates as alkaline builders and nonionic and/or anionic surfactants and, optionally, other builders and/or complexing agents and/or other active substances or auxiliaries known per se in dispersed form, characterized in that they contain a combination of a) polyacrylic acid and/or alkali metal polyacrylates and b) glycerol and/or polyglycerol as stabilizers.

The dispersions provided in accordance with the invention are distinguished by the following properties:

very high solids/active substance contents very small quantities of additional dispersion aids which are alkali-stable, inexpensive and in addition largely (rapidly) biodegradable;

the wetting agents typically used in cleaning are chemically stable in the dispersion and do not separate;

the dispersions have an improved dissolving rate compared with powders.

Sodium and/or potassium are preferably used as alkali metals for the purposes of the invention. Mixtures of corresponding sodium and potassium compounds may also be used. However, it is particularly preferred to use sodium as the alkali metal.

As mentioned above, the cleaning concentrates according to the invention are based on aqueous solutions of alkali metal hydroxides which contain the alkaline builders, the nonionic and/or anionic surfactants, the stabilizers and the optional ingredients in dispersed form. In a preferred embodiment of the invention, a 40 to 50% by weight aqueous solution of sodium hydroxide is used as the aqueous alkali metal hydroxide solution.

According to the invention, alkali metal silicates and/or alkali metal phosphates are used as the alkaline builders, the corresponding sodium compounds being preferred. So far as the alkali metal silicates are concerned, sodium silicates with a molar $SiO_2$:$Na_2O$ ratio of 1:1 to 3.5:1 are preferably used, sodium silicates with a molar $SiO_2$:$Na_2O$ ratio of 1:1 being particularly preferred. The cleaning concentrates according to the invention contain such sodium silicates in a quantity of 5 to 80% by weight, based on the aqueous sodium hydroxide solution. Through the combination of sodium silicates with sodium hydroxide, the molar $SiO_2$:$Na_2O$ ratio of this combination changes to lower values. In a preferred embodiment of the invention, the resulting molar $SiO_2$:$Na_2O$ ratio, based on the combination of sodium silicate and sodium hydroxide, is in the range from 0.1:1 to 0.5:1.

As already mentioned, the cleaning concentrates according to the invention may contain as alkaline builders alkali metal phosphates which are dispersed in the sodium hydroxide solution either together with or instead of the alkali metal silicates. According to the invention, sodium triphosphate (also known as tripolyphosphate) and/or sodium pyrophosphate are preferably used as the alkali metal phosphates, sodium pyrophosphate being preferred. The cleaning concentrates according to the invention contain such sodium phosphates in a quantity of 5 to 50% by weight and preferably in a quantity of 10 to 50% by weight, based on the aqueous sodium hydroxide solution.

Examples of nonionic surfactants which may be used for the purposes of the invention are ethoxylated or propoxylated alcohols, phenols and amines. Fatty alcohols with a chain length of 12 to 18 carbon atoms, oxoalcohols with a chain length of 9 to 15 carbon atoms, nonylphenol and fatty amines with a chain length of 12 to 18 carbon atoms—all containing 1 to 14 moles of ethylene oxide (EO) or propylene oxide (PO)—are particularly suitable nonionic surfactants.

Examples of such nonionic surfactants are $C_{12-18}$ fatty alcohols ethoxylated with 4, 9 or 14 moles of EO; oleyl alcohol ethoxylated with 2 or 10 moles of EO; $C_{9-12}$ oxoalcohol ethoxylated with 6 moles of EO; $C_{11-15}$ oxoalcohols ethoxylated with 7 to 9 moles of EO; nonylphenol ethoxylated with 6 or 12 moles of EO; $C_{12-18}$ fatty amines (coconut oil fatty amine) ethoxylated with 12 moles of EO; $C_{14-18}$ fatty amines (tallow amine) ethoxylated with 12 moles of EO. The corresponding propoxylated compounds may also be used.

Examples of the anionic surfactants which may be used for the purposes of the invention are linear or branched, saturated or unsaturated carboxylic acids containing 10 to 18 carbon atoms and alkali metal salts thereof, preferably sodium salts, more particularly corresponding fatty acid soaps; alkylbenzenesulfonates containing 8 to 18 carbon atoms in the alkyl component; alkanesulfonates containing 12 to 18 carbon atoms in the alkane component; α-olefinsulfonates containing 12 to 18 carbon atoms in the olefin component; α-sulfofatty acids of $C_{12-18}$ fatty acid methyl esters; fatty alcohol sulfates containing 8 to 18 carbon atoms in the fatty alcohol component and fatty alcohol ether sulfates containing 12 to 16 carbon atoms in the fatty alcohol component and 2 to 4 moles of ethylene oxide.

The cleaning concentrates according to the invention contain such nonionic and/or anionic surfactants in a quantity of 0.1 to 10% by weight and preferably in a quantity of 1 to 3% by weight, based on the overall composition of the cleaning concentrates.

Depending on the degree of alkoxylation, the non-ionic surfactants may be used as required for cleaning, emulsification and defoaming.

Where the cleaning solutions have to meet various requirements, mixtures of the nonionic surfactants may also be used. The same also applies to mixtures of anionic surfactants and to mixtures of nonionic and anionic surfactants. It is generally preferred to use nonionic surfactants.

In addition, the cleaning concentrates according to the invention contain as key constituents a combination of a) polyacrylic acid and/or alkali metal polyacrylates and b) glycerol and/or polyglycerol for stabilizing the dispersion.

In a preferred embodiment of the invention, the cleaning concentrates contain polyacrylic acid and/or alkali metal polyacrylates in a quantity of 0.5 to 10% by weight and, more particularly, in a quantity of 2 to 6% by weight, based on the solids dispersed in the dispersion.

The use of polyacrylic acid as opposed to the neutralized sodium form—for the same molecular weight—has proved to be of greater advantage in regard to the dispersion stability achieved. The polyacrylic acids to be used are already known in principle from U.S. Pat. No. 4,521,332. It is preferred to use polyacrylic acids rather than the salts because, in contrast to the salts, the free acids are far more soluble in water and can thus be applied very effectively to the solids to be dispersed, even in combination with the nonionic and/or anionic surfactants used, in a first production step. The particularly preferred molecular weight of the polyacrylic acids is in the range from 500 to 12,000 and preferably below 10,000. The best results are obtained using a 63% by weight solution of a polyacrylic acid with a molecular weight of 2,100. Higher molecular weights of the polyacrylic acids merely lead to increased viscosities for the same active substance contents. Where alkali metal salts of polyacrylic acid, such as sodium polyacrylates for example, are used, the molecular weight of the sodium has to be taken into account in regard to the quantity used.

Other constituents of the stabilizer combination according to the invention are glycerol and/or polyglycerol. They are present in the cleaning concentrates according to the invention in a quantity of 0.5 to 10% by weight and, more particularly, in a quantity of 1 to 3% by weight, based on the overall composition of the cleaning concentrates. Polyglycerols suitable for the purposes of the invention are known, for example, from Ullmanns Encyklopädie der technischen Chemie, 4th Edition 1976, Vol. 12, page 374. The polyglycerols have relative molecular weights of 166 (6 carbon atoms) to 2238 (90 carbon atoms) and contain 4 to 32 hydroxyl groups. They are obtained by alkali-catalyzed polycondensation of glycerol with elimination of water (linkage through ester functions). This reaction gives oligomer mixtures of which the average degree of polymerization may be determined, for example, through the OH value.

In addition to the active-substance components mentioned above, the cleaning concentrates according to the invention may also contain other constituents typically used in alkaline cleaners, more particularly additional alkaline builders, complexing agents, foam inhibitors and corrosion inhibitors. The following are examples of compounds particularly suitable for the purposes of the invention:

Additional alkaline builders: alkanolamines, such as mono-, di- or triethanolamine; alkali metal carbonates, such as sodium carbonate; alkali metal gluconates, more particularly sodium or potassium gluconate; and other alkali metal hydroxides, i.e. in particular sodium hydroxide. The cleaning concentrates according to the invention contain these additional alkaline builders in a quantity of 1 to 15% by weight and preferably in a quantity of 3 to 10% by weight, based on the overall composition of the cleaning concentrates.

Complexing agents: polycarboxylic acids, phosphonic acids, such as hydroxyethane-1,1-diphosphonic acid (HEDP), amino-tris-(methylenephosphonic acid) (ATMP); aminopolycarboxylic acids, such as for example ethylenediamine tetraacetic acid (EDTA) or nitrilotriacetic acid (NTA); polyhydroxycarboxylic acids, for example citric acid; and water-soluble salts of these acids, preferably the sodium salts. The cleaning concentrates according to the invention may contain such complexing agents in a quantity of 0.5 to 5% by weight and preferably in a quantity of 2 to 4% by weight, based on the overall composition of the cleaning concentrates. Foam inhibitors: $C_{12/18}$ fatty alcohol (coconut oil fatty alcohol) polyethylene glycol butylether, ethylenediamine+30EO+60PO; both in quantities of 0.1 to 5% by weight, based on the overall composition of the cleaning concentrates.

Corrosion inhibitors: (for nonferrous metals) benztriazole, tolyl triazole; both in quantities of 0.1 to 5% by weight, based on the overall composition of the cleaning concentrates.

There is generally no need whatever for additives such as these to be used for the purposes of the invention. However, they may be of advantage, depending on the particular application, and may be used in the particular quantities required.

The pumpable alkaline cleaning concentrates according to the invention are generally prepared as follows: the builders are first mixed as solids with the wetting agents used in the cleaner, i.e. the nonionic and/or anionic surfactants, and the stabilizers, i.e. with polyacrylic acid and glycerol/polyglycerol, and any other ingredients to be used. In a second step, the resulting mixture is dispersed in technical 40 to 50% by weight aqueous sodium hydroxide solution. The builders, surfactants, stabilizers and the other ingredients optionally used may be individually dispersed in any order in the aqueous sodium hydroxide solution. It is important in this regard that dispersion take place under the effect of intensive shear, thrust and friction forces, for example by using so-called ROTOR/STATOR systems. The ROTOR/STATOR systems used are commercial makes of the type manufactured, for example, by Janke & Kunkel GmbH & Co. (Ultra-Turrax), by Silverson, by Fryma (toothed colloid mill), by Cavitron (Cavitron) or by Krupp (Supraton). The ROTOR/STATOR systems may be constructed both as chamber, cavity or cone tools.

The cleaning concentrates according to the invention may be produced at room temperature. However, the dispersion process is preferably carried out at elevated temperature, i.e. at temperatures of up to 220° C., temperatures in the range from 50° to 60° C. being particularly preferred. The production of the cleaning concentrates may of course be carried out both discontinuously and continuously.

The present invention also relates to the use of the cleaning concentrates according to the invention in the cleaning of metal surfaces, particularly steel, nonferrous metals, copper, aluminium and zinc before finishing processes, such as phosphating, electroplating, enameling and painting, and in intermediate cleaning before processing, particularly before annealing.

Although the cleaning concentrates according to the invention may of course also be used in undiluted form, it is preferred for the purposes of the invention to use the cleaning concentrates in such a way that an aqueous solution containing 1 to 20% by weight of cleaning concentrate is used for the cleaning processes mentioned above. Accordingly, preferred cleaning solutions contain 10 to 200 g/l of the cleaning concentrates according to the invention. To prepare dilute in-use solutions, i.e. cleaning solutions, the cleaning concentrates are generally introduced directly into the cleaning bath with stirring.

The advantage of the pumpable alkaline cleaning concentrates according to the invention is, on the one hand, that they have a high builder content and, at the same time, show extremely high stability in storage and, on the other hand, that they are easy to dose.

Accordingly, the invention provides products suitable for any industrial cleaning applications, for example for spray cleaning, brush cleaning, dip cleaning and ultrasonic cleaning and for electrolytic cleaning. Predetermined cloud points can be adjusted by suitable combinations so that high-temperature or low-temperature cleaners can be prepared.

EXAMPLES

The following Examples are intended to illustrate the invention.

In the Examples and Comparison Examples, the nonionic surfactants were melted together with the polyacrylic acid solution and the glycerol and the resulting mixture was subsequently mixed with the builders, i.e. in particular sodium metasilicate and/or sodium pyrophosphate, in a laboratory mixer. The mixture was then stirred into a commercially available 50% by weight sodium hydroxide solution, heated to 60° C. and then dispersed with a high-performance disperser. The dispersions according to the invention remain stable to sedimentation for several weeks at room temperature and do not show any change in their flow behavior whereas comparison dispersions undergo phase separation after only a relatively short time, making corresponding products unsuitable for industrial application.

Example 1

A pumpable alkaline cleaning concentrate was prepared as described above from 53% by weight of a 50% by weight sodium hydroxide solution, 40.3% by weight of sodium metasilicate KO with a particle size distribution of 20%<0.4 mm, 40%<0.2 mm, 20%<0.1 mm and 15%<0.05 mm (sodium metasilicate KO=$Na_2SiO_3$, anhydrous).

The cleaning concentrate also contains 1.7% by weight of polyacrylic acid (Good-Rite K 752 (63%)) with a molecular weight of 2100, a sodium content of 0.8% and a pH value of 2.2 to 3. The nonionic surfactant base was a combination of equal parts of a $C_{12-18}$ fatty alcohol•14 EO (OH value 68 to 74, AS 100%) and a modified fatty alcohol polyglycol ether based on coconut oil Lorol•9.5 EO, end-capped with butyl ether. The mixture of the two surfactants is present in the cleaning concentrate in a quantity of 2% by weight. In addition, the cleaning concentrate contains 3% by weight of glycerol.

Even after storage for several weeks at room temperature, no phase separation occurred.

Example 2

A pumpable alkaline cleaning concentrate was prepared using 8.0% by weight of solid sodium hydroxide, 74.7% by weight of 50% by weight sodium hydroxide, 0.9% by weight of diglycerol (OHV 1300), 9.6% by weight of sodium pyrophosphate (tetrasodium diphosphate $Na_4P_2O_7$), 3.2% by weight of sodium gluconate, 1.1% by weight of the polyacrylic acid mentioned above, 1.4% by weight of the nonionic surfactant mixture mentioned above and 1.1% by weight of glycerol.

Even after 8 weeks, no phase separation occurred.

Example 3

A cleaning concentrate which remained stable for 8 weeks was prepared as in Example 2 using 0.6% by weight of polyacrylic acid, 9.7% by weight of sodium pyrophosphate and 75.1% by weight of 50% sodium hydroxide solution instead of the constituents mentioned in Example 2.

Comparison Example 1

A cleaning concentrate was prepared using 54.7% by weight of 50% sodium hydroxide solution, 41.5% by weight of the sodium metasilicate mentioned above, 1.8% by weight of the polyacrylic acid mentioned above, 2.0% by weight of the surfactant base mentioned above, but no glycerol. Phase separation occurred after only 2 days.

Comparison Example 2

A cleaning concentrate was prepared using 53.9% by weight of the 50% sodium hydroxide solution, 41.0% by weight of the sodium metasilicate mentioned above, 2% by weight of the surfactant base mentioned above and 3.1% by weight of glycerol. Phase separation occurred after only 1 day.

Comparison Example 3

A cleaning concentrate was prepared using 8.2% by weight of sodium hydroxide (solid), 76.2% by weight of 50% sodium hydroxide solution, 9.8% by weight of sodium pyrophosphate, 3.3% by weight of sodium gluconate, 1.1% by weight of polyacrylic acid and 1.4% by weight of the surfactant base mentioned above. Phase separation occurred after only 3 days.

Comparison Example 4

A cleaning concentrate was prepared using 8.2% by weight of sodium hydroxide (solid), 75.4% by weight of 50% sodium hydroxide solution, 0.9% by weight of diglycerol, 9.8% by weight of sodium pyrophosphate, 3.2% by weight of sodium gluconate, 1.4% by weight of surfactant base and 1.1% by weight of glycerol. Phase separation occurred after only 1 day.

We claim:

1. A storable, pumpable alkaline cleaning concentrate comprising an aqueous alkali metal hydroxide dispersion containing alkaline builders, nonionic or anionic surfactants, and a stabilizer therefor comprising the combination of:

(a) 0.5 to 10% by weight of polyacrylic acid or alkali metal polyacrylate; and (b) 0.5 to 10% by weight of glycerol or polyglycerol.

2. The concentrate of claim 1 wherein said aqueous alkali metal hydroxide comprises a 40 to 50% by weight aqueous solution of sodium hydroxide.

3. The concentrate of claim 1 wherein said alkaline builders are selected from the group consisting of alkali metal silicates, alkali metal phosphates and mixtures thereof.

4. The concentrate of claim 3 wherein said alkali metal silicates comprise sodium silicates having a molar $SiO_2$:$Na_2O$ ratio of from 1:1 to 3.5:1.

5. The concentrate of claim 4 wherein said sodium silicates are present in an amount of from 5 to 80% by weight, based on the weight of said aqueous alkali metal hydroxide.

6. The concentrate of claim 3 wherein said alkali metal phosphates are selected from the group consisting of sodium triphosphate, sodium pyrophosphate and mixtures thereof.

7. The concentrate of claim 6 wherein said alkali metal phosphates are present in an amount of from 5 to 50% by weight, based on the weight of said aqueous alkali metal hydroxide.

8. The concentrate of claim 1 wherein said nonionic surfactants are selected from the group consisting of adducts of 1 to 14 moles of ethylene oxide with $C_{12-18}$ fatty alcohols, adducts of 1 to 14 moles of ethylene oxide with $C_{9-15}$ oxoalcohols, adducts of 1 to 14 moles of ethylene oxide with $C_{12-18}$ fatty amines, adducts of 1 to 14 moles of ethylene oxide with nonylphenol, adducts of 1 to 14 moles of propylene oxide with $C_{12-18}$ fatty alcohols, adducts of 1 to 14 moles of propylene oxide with $C_{9-15}$ oxoalcohols, adducts of 1 to 14 moles of propylene oxide with $C_{12-18}$ fatty amines, adducts of 1 to 14 moles of propylene oxide with nonylphenol, and mixtures thereof.

9. The concentrate of claim 1 wherein said anionic surfactants are selected from the group consisting of linear, branched, saturated or unsaturated $C_{10-18}$ carboxylic acids and alkali metal salts thereof, alkyl benzenesulfonates having 8 to 18 carbon atoms in the alkyl component, alkanesulfonates having 12 to 18 carbon atoms in the alkane component, α-olefin sulfonates having 12 to 18 carbon atoms in the olefin component, α-sulfofatty acid esters of $C_{12-18}$ fatty acid methyl esters, fatty alcohol sulfates having 8 to 18 carbon atoms in the fatty alcohol component, fatty alcohol ether sulfates having 12 to 16 carbon atoms in the fatty alcohol component and containing 2 to 4 moles of ethylene oxide, and mixtures thereof.

10. The concentrate of claim 1 wherein said surfactants are present in an amount of from 0.1 to 10% by weight, based on the weight of said concentrate.

11. The concentrate of claim 1 wherein said polyacrylic acid has a molecular weight in the range from 500 to 12,000.

12. The concentrate of claim 1 wherein said polyglycerol has a relative molecular weight of from 166 to 2238 and contains 4 to 32 hydroxyl groups.

13. The concentrate of claim 1 wherein said concentrate contains from 1 to 15% by weight, based on the weight of said concentrate, of additional alkaline builders selected from the group consisting of alkali metal carbonates, alkali metal gluconates, and mixtures thereof.

14. The concentrate of claim 1 wherein said concentrate contains from 0.5 to 5% by weight, based on the weight of said concentrate, of a complexing agent selected from the group consisting of polycarboxylic acids, polyhydroxycarboxylic acids, aminopolycarboxylic acids, phosphonic acids, water soluble salts of polycarboxylic acids, water soluble salts of polyhydroxycarboxylic acids, water soluble salts of aminopolycarboxylic acids, water soluble salts of phosphonic acids, and mixtures thereof.

15. A process for the production of a storable, pumpable alkaline cleaning concentrate comprising providing an aqueous alkali metal hydroxide dispersion containing alkaline builders and surfactants, and adding thereto a stabilizer combination comprising:

(a) 0.5 to 10% by weight of polyacrylic acid or alkali metal polyacrylate; and (b) 0.5 to 10% by weight of glycerol or polyglycerol.

16. The process of claim 15 wherein said aqueous alkali metal hydroxide comprises a 40 to 50% by weight aqueous solution of sodium hydroxide.

17. The process of claim 15 wherein said alkaline builders are selected from the group consisting of alkali metal silicates, alkali metal phosphates and mixtures thereof.

18. The process of claim 17 wherein said alkali metal silicates comprise sodium silicates having a molar $SiO_2$:$Na_2O$ ratio of from 1:1 to 3.5:1.

19. The process of claim 18 wherein said sodium silicates are present in an amount of from 5 to 80% by weight, based on the weight of said aqueous alkali metal hydroxide.

20. The process of claim 17 wherein said alkali metal phosphates are selected from the group consisting of sodium triphosphate, sodium pyrophosphate and mixtures thereof.

21. The process of claim 20 wherein said alkali metal phosphates are present in an amount of from 5 to 50% by weight, based on the weight of said aqueous alkali metal hydroxide.

22. The process of claim 15 wherein said surfactants are selected from the group consisting of nonionic surfactants, anionic surfactants and mixtures thereof.

23. The process of claim 22 wherein said nonionic surfactants are selected from the group consisting of adducts of 1 to 14 moles of ethylene oxide with $C_{12-18}$ fatty alcohols, adducts of 1 to 14 moles of ethylene oxide with $C_{9-15}$ oxoalcohols, adducts of 1 to 14 moles of ethylene oxide with $C_{12-18}$ fatty amines, adducts of 1 to 14 moles of ethylene oxide with nonylphenol, adducts of 1 to 14 moles of propylene oxide with $C_{12-18}$ fatty alcohols, adducts of 1 to 14 moles of propylene oxide with $C_{9-15}$ oxoalcohols, adducts of 1 to 14 moles of propylene oxide with $C_{12-18}$ fatty amines, adducts of 1 to 14 moles of propylene oxide with nonylphenol, and mixtures thereof.

24. The process of claim 22 wherein said anionic surfactants are selected from the group consisting of linear, branched, saturated or unsaturated $C_{10-18}$ carboxylic acids and alkali metal salts thereof, alkyl benzenesulfonates having 8 to 18 carbon atoms in the alkyl component, alkanesulfonates having 12 to 18 carbon atoms in the alkane component, α-olefin sulfonates having 12 to 18 carbon atoms in the olefin component, α-sulfofatty acid esters of $C_{12-18}$ fatty acid methyl esters, fatty alcohol sulfates having 8 to 18 carbon atoms in the fatty alcohol component, fatty alcohol ether sulfates having 12 to 16 carbon atoms in the fatty alcohol component and containing 2 to 4 moles of ethylene oxide, and mixtures thereof.

25. The concentrate of claim 15 wherein said surfactants are present in an amount of from 0.1 to 10% by weight, based on the weight of said concentrate.

26. The process of claim 15 wherein said polyacrylic acid has a molecular weight in the range from 500 to 12,000.

27. The process of claim 15 wherein said polyglycerol has a relative molecular weight of from 166 to 2238 and contains 4 to 32 hydroxyl groups.

28. The process of claim 15 wherein said concentrate contains from 1 to 15% by weight, based on the weight of said concentrate, of additional alkaline builders selected from the group consisting of alkali metal carbonates, alkali metal gluconates, and mixtures thereof.

29. The process of claim 15 wherein said concentrate contains from 0.5 to 5% by weight, based on the weight of said concentrate, of a complexing agent selected from the group consisting of polycarboxylic acids, polyhydroxycarboxylic acids, aminopolycarboxylic acids, phosphonic acids, water soluble salts of polycarboxylic acids, water soluble salts of polyhydroxycarboxylic acids, water soluble salts of aminopolycarboxylic acids, water soluble salts of phosphonic acids, and mixtures thereof.

* * * * *